US008919759B2

(12) United States Patent
De Santi et al.

(10) Patent No.: US 8,919,759 B2
(45) Date of Patent: Dec. 30, 2014

(54) INPUT FEEDER DEVICE FOR AN APPARATUS FOR PROCESSING PAPER DOCUMENTS, PARTICULARLY BANK CHEQUES

(71) Applicants: Ivano De Santi, Pianezza (IT); Ugo Panini, Torino (IT)

(72) Inventors: Ivano De Santi, Pianezza (IT); Ugo Panini, Torino (IT)

(73) Assignee: Panini S.p.A., Torino (IT)

( * ) Notice: Subject to any disclaimer, the term of this patent is extended or adjusted under 35 U.S.C. 154(b) by 0 days.

(21) Appl. No.: 14/353,414

(22) PCT Filed: Oct. 25, 2012

(86) PCT No.: PCT/IB2012/055875

§ 371 (c)(1),
(2), (4) Date: Apr. 22, 2014

(87) PCT Pub. No.: WO2013/061270

PCT Pub. Date: May 2, 2013

(65) Prior Publication Data

US 2014/0284870 A1 Sep. 25, 2014

(30) Foreign Application Priority Data

Oct. 25, 2011 (IT) ..... TO2011A0965

(51) Int. Cl.

| | |
|---|---|
| ***B65H 9/16*** | (2006.01) |
| ***B65H 5/06*** | (2006.01) |
| ***B65H 3/06*** | (2006.01) |
| ***B65H 9/00*** | (2006.01) |

(52) U.S. Cl.

CPC ..... *B65H 3/0669* (2013.01); *B65H 5/06* (2013.01); *B65H 9/002* (2013.01); *B65H 2404/661* (2013.01); *B65H 9/16* (2013.01); *B65H 2404/56* (2013.01)

USPC ..... 271/3.02; 271/241; 271/117

(58) Field of Classification Search

CPC ..... B65H 2404/56; B65H 2404/66; B65H 2404/661; B65H 9/16; B65H 9/002; B65H 5/06

USPC ..... 271/3.02, 117, 241

See application file for complete search history.

(56) References Cited

U.S. PATENT DOCUMENTS

| | | | | |
|---|---|---|---|---|
| 4,103,885 | A * | 8/1978 | Fox | 271/117 |
| 4,270,745 | A * | 6/1981 | Woodard | 271/9.05 |
| 4,272,068 | A * | 6/1981 | Garrison et al. | 271/117 |

FOREIGN PATENT DOCUMENTS

| | | |
|---|---|---|
| EP | 1 453 014 A2 | 9/2004 |
| EP | 1 965 582 A1 | 9/2008 |
| EP | 2 030 925 A2 | 3/2009 |

*Primary Examiner* — Patrick Cicchino

(74) *Attorney, Agent, or Firm* — Dickstein Shapiro LLP

(57) ABSTRACT

The feeder device comprises a support structure (2) wherein, between a feeder plate (3) and an opposite surface (4), there is defined an input receptacle (5) for the introduction of one or more documents (BC) to be processed, and a motorized aligning and conveying device (6), adapted to engage and urge a document (BC) introduced into the input receptacle (5) towards a lateral stationary aligning surface (50). The feeder device is characterized in that the aligning and conveying device comprises an assembly (10) which is rotatable about a first axis (A) and which includes a pick-up member (24) rotatable in the assembly (10) about a second axis (B) spaced apart from the first axis (A), between a first, resting angular position and a second, working angular position, in the first of which positions the pick-up member (24) is retracted, while in the second it protrudes into the assembly (10) in the input receptacle (5) to engage a document (BC) introduced thereinto; and an electric control motor (18), coupled to the assembly (10) and to the pick-up member (24) through transmission means (12-22, 30-33).

5 Claims, 9 Drawing Sheets

INPUT FEEDER DEVICE FOR AN APPARATUS FOR PROCESSING PAPER DOCUMENTS, PARTICULARLY BANK CHEQUES

The present invention relates to an input feeder device for an apparatus for processing paper documents and the like, particularly bank cheques.

More specifically, the invention relates to an input feeder device comprising:

- a support structure wherein, between a feeder plate and an opposite surface, there is defined an input receptacle for the introduction of one or more documents to be processed, and
- a motorized aligning and conveying device, arranged by said input receptacle and adapted to engage and urge a document (BC) introduced thereinto towards a lateral stationary aligning surface.

There are known feeder devices of this type comprising a plurality of pick-up members, generally in the form of wheels, which are associated with complex motorized movement devices.

One object of the present invention is to provide a feeder device of the type specified above, which comprises a highly simplified aligning and conveying device, includes a single rotatable pick-up member, and can be driven as a whole by a single electric driving motor.

This and other objects are achieved according to the invention with a feeder device of the type specified above, characterized in that the aligning and conveying device comprises:

- an assembly which is rotatable about a first axis which intersects the feeder plate, and which includes a pick-up member mounted rotatably in the assembly about a second axis, in a plane spaced apart from the first axis, between a first, resting angular position and a second, working angular position, in the first of which positions the pick-up member is retracted, while in the second it protrudes from the assembly into the input receptacle and is adapted to engage a document introduced thereinto; and
- electric control motor means, coupled to the assembly through transmission means adapted to cause:
- while the assembly is in a predetermined initial angular position, the passage of the pick-up member from the resting position to the working position, to engage a document introduced into the input receptacle,
- thereafter, a rotation of the assembly from the initial angular position to a final angular position, about the first axis, while the pick-up member is in its working position, to urge said document towards and against the aligning surface,
- thereafter, while the assembly is in the final position, a rotation of the pick-up member about the second axis, to convey the aligned document into the processing apparatus; and
- finally, the return of the assembly to the initial position, and the return of the pick-up member to the resting position.

Other features and advantages of the invention will be made clear by the following detailed description, provided purely by way of non-limiting example, with reference to the appended drawings, in which.

Figure 9A:
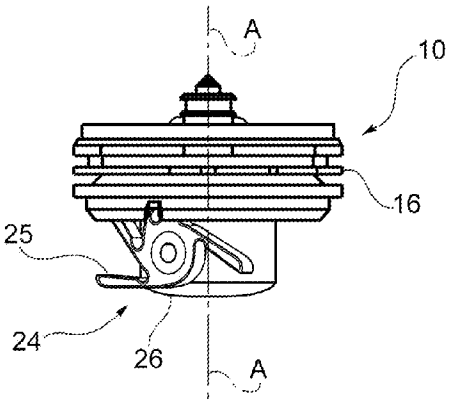
Figure 9B:
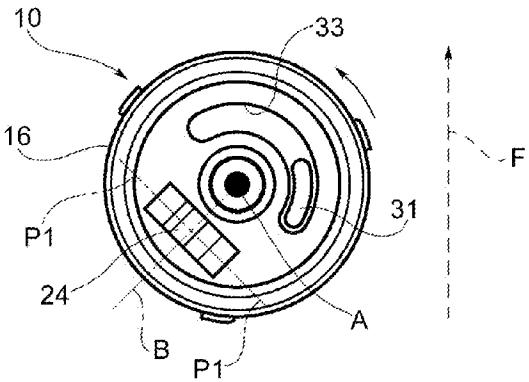
Figure 13:
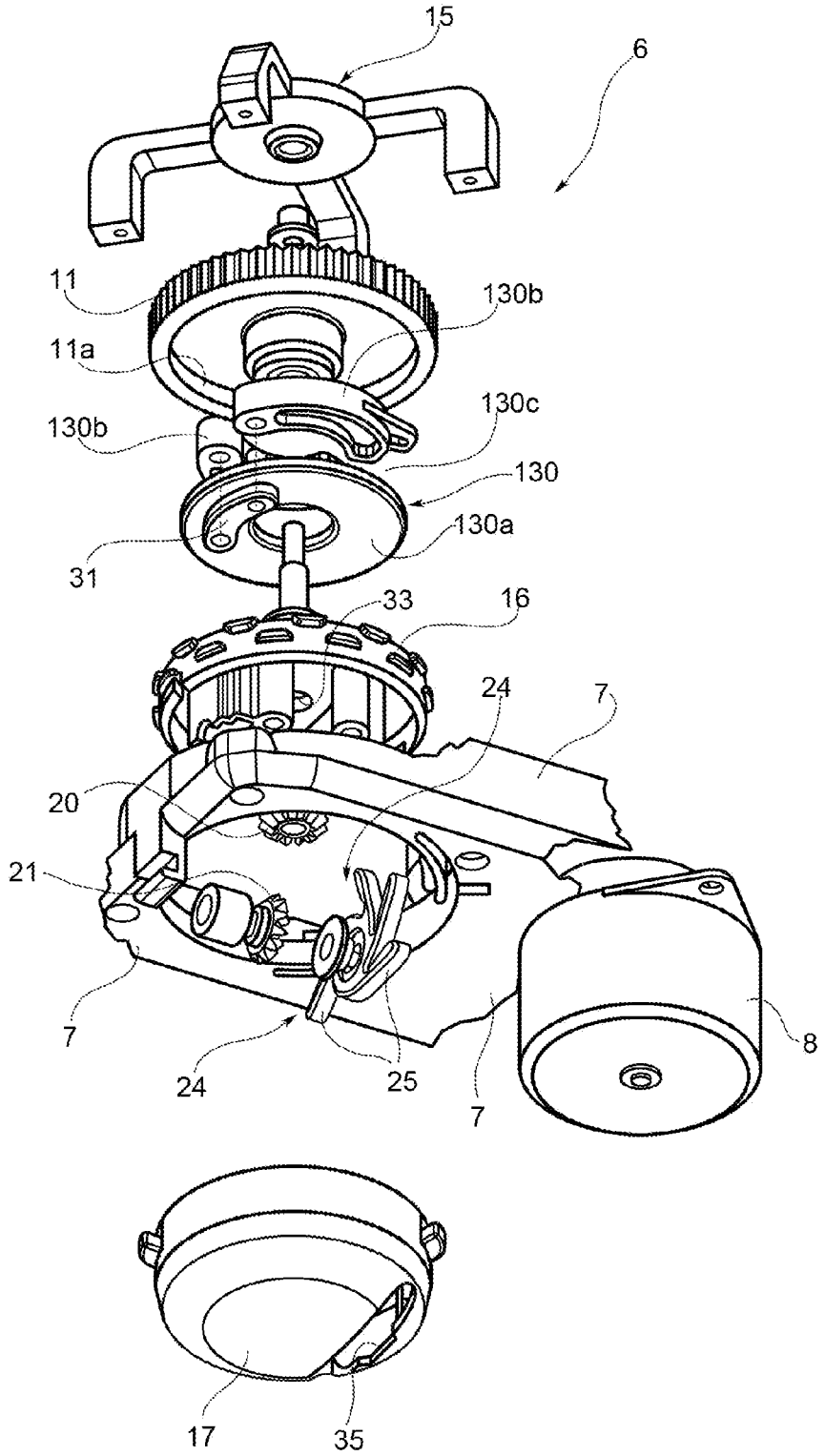

FIGS. 9*a* and 9*b* are two partial views, in lateral elevation and in plan respectively, of an aligning assembly included in a device according to the invention, shown in an initial step of an operating cycle;

FIGS. 10*a*, 10*b* and 11*a*, 11*b*, together with 12*a*, 12*b*, are views similar to those of FIGS. 9*a*, 9*b*, and show the aligning assembly in further conditions of an operating cycle; and FIG. 13 is an exploded partial perspective view of a variant embodiment of an aligning and conveying assembly for a feeder device according to the invention.

Figure 1:
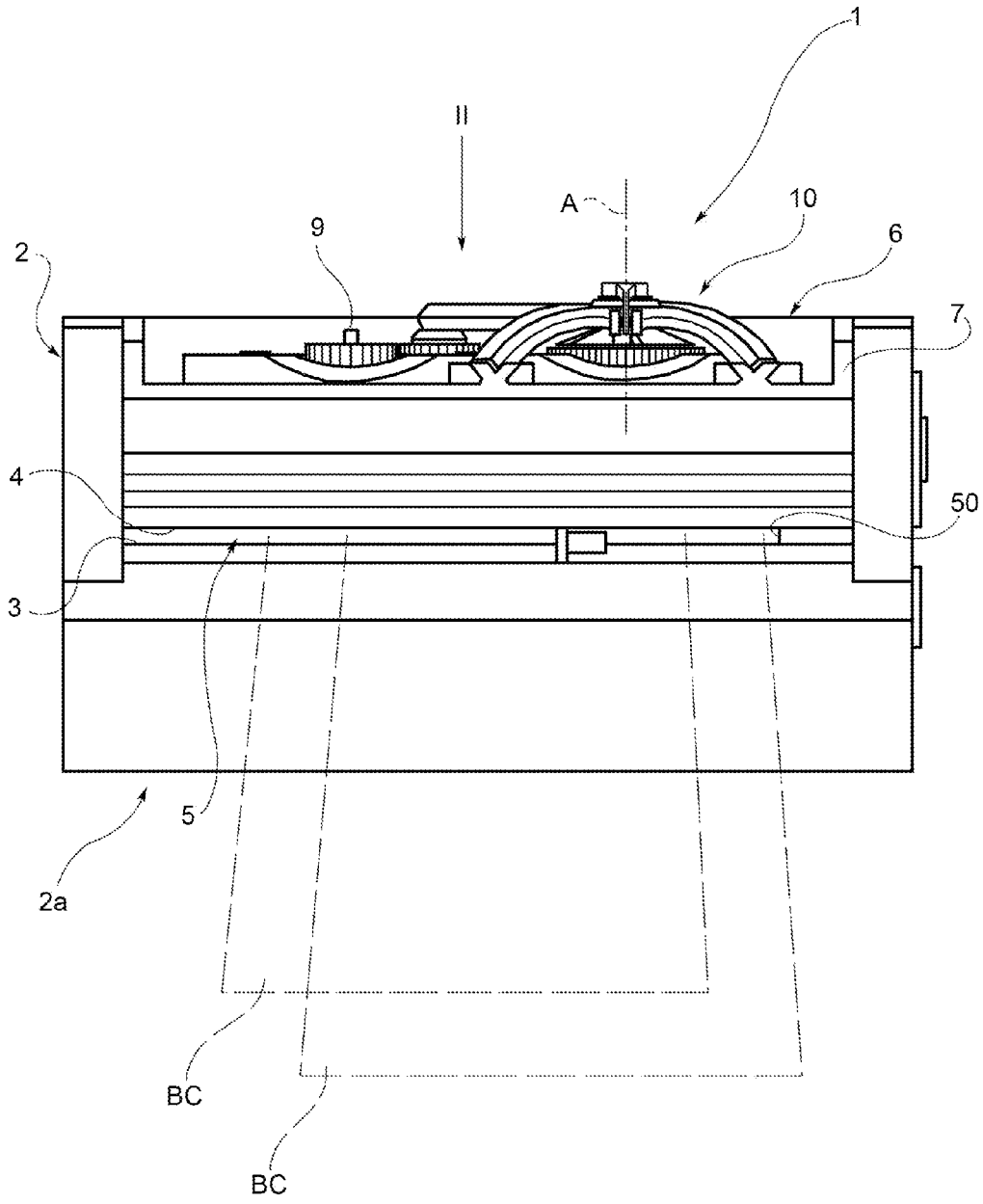
FIG. 1 is a front view of an apparatus for processing paper documents, particularly bank cheques, comprising an input feeder device according to the present invention.
Figure 2:
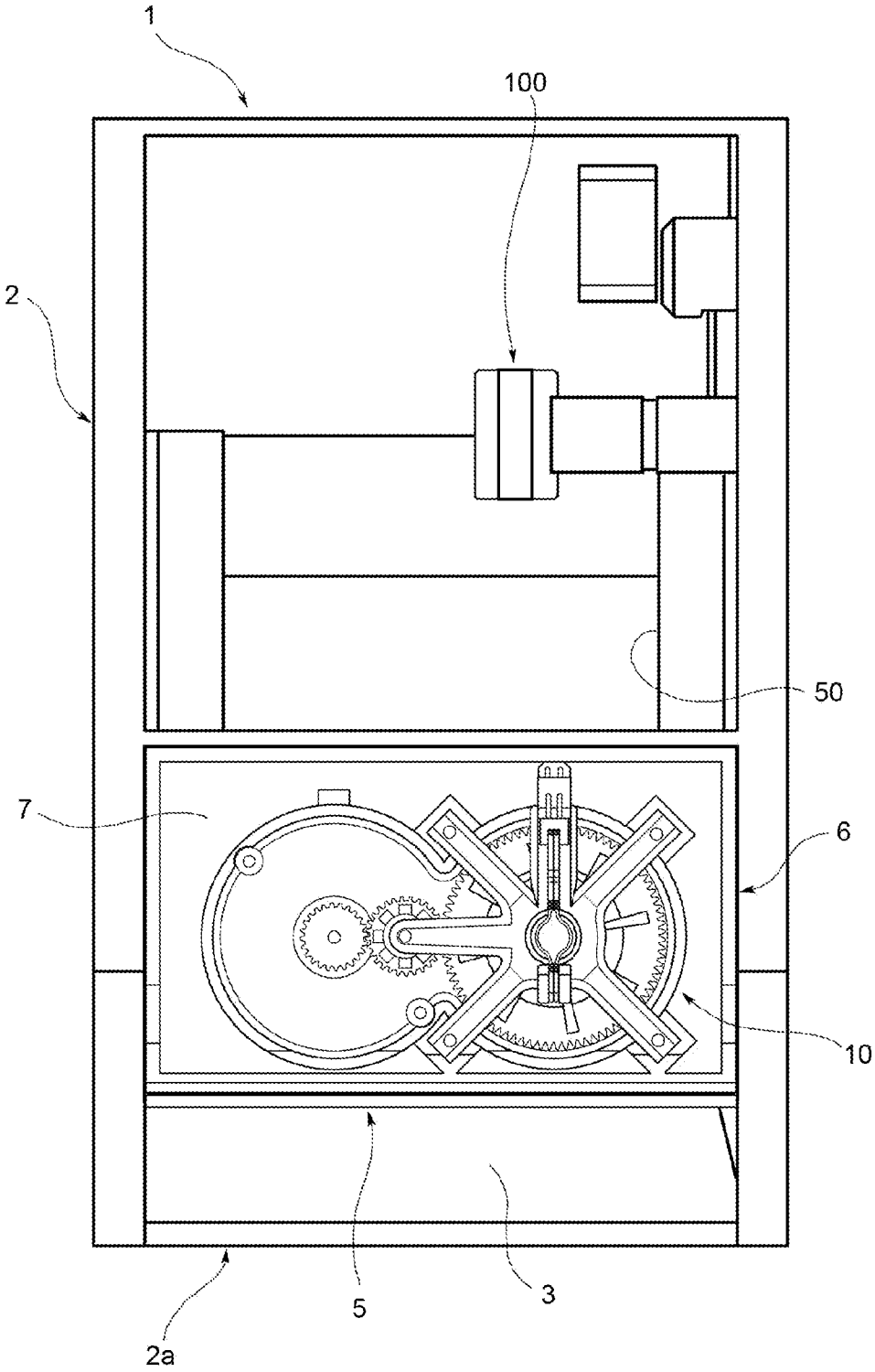
FIG. 2 is a plan view from above of the apparatus shown in FIG. 1.
Figure 3:
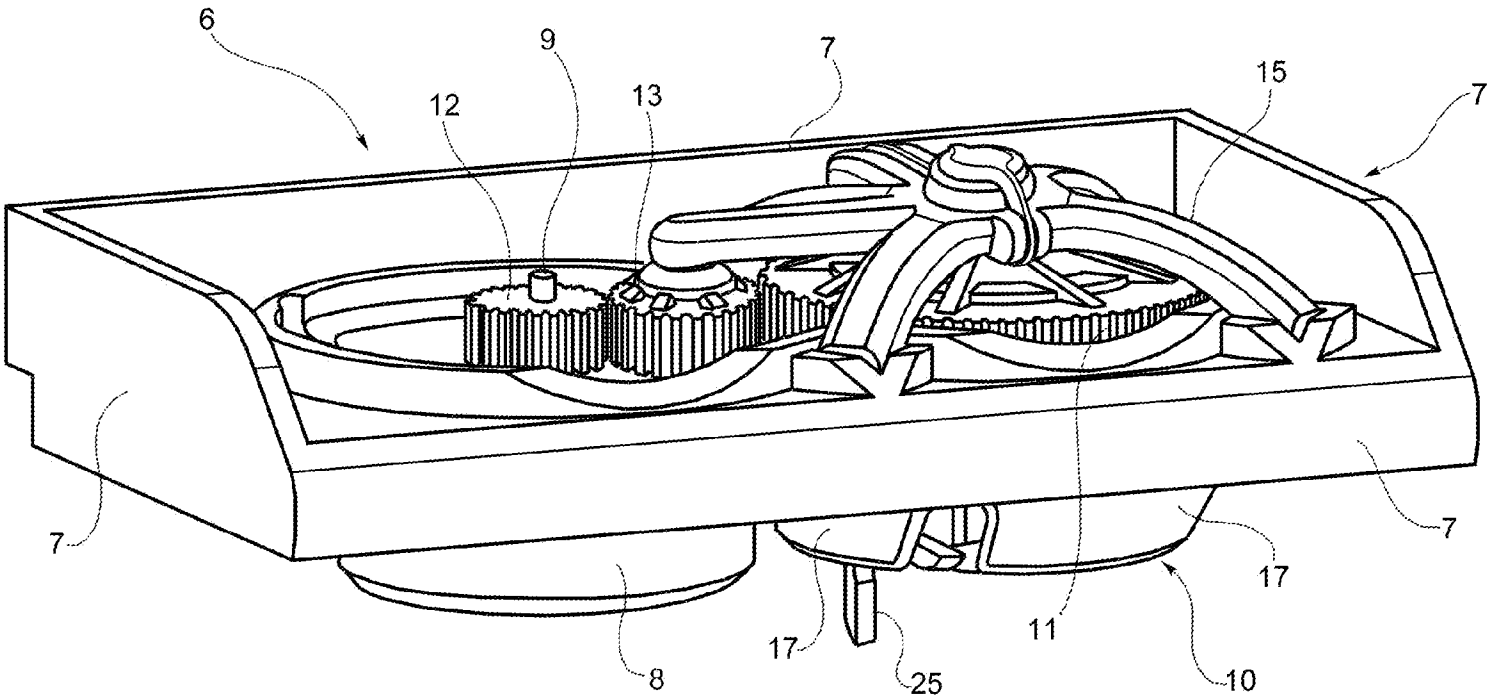
FIG. 3 is a perspective view of an input feeder device according to the present invention.
Figure 4:
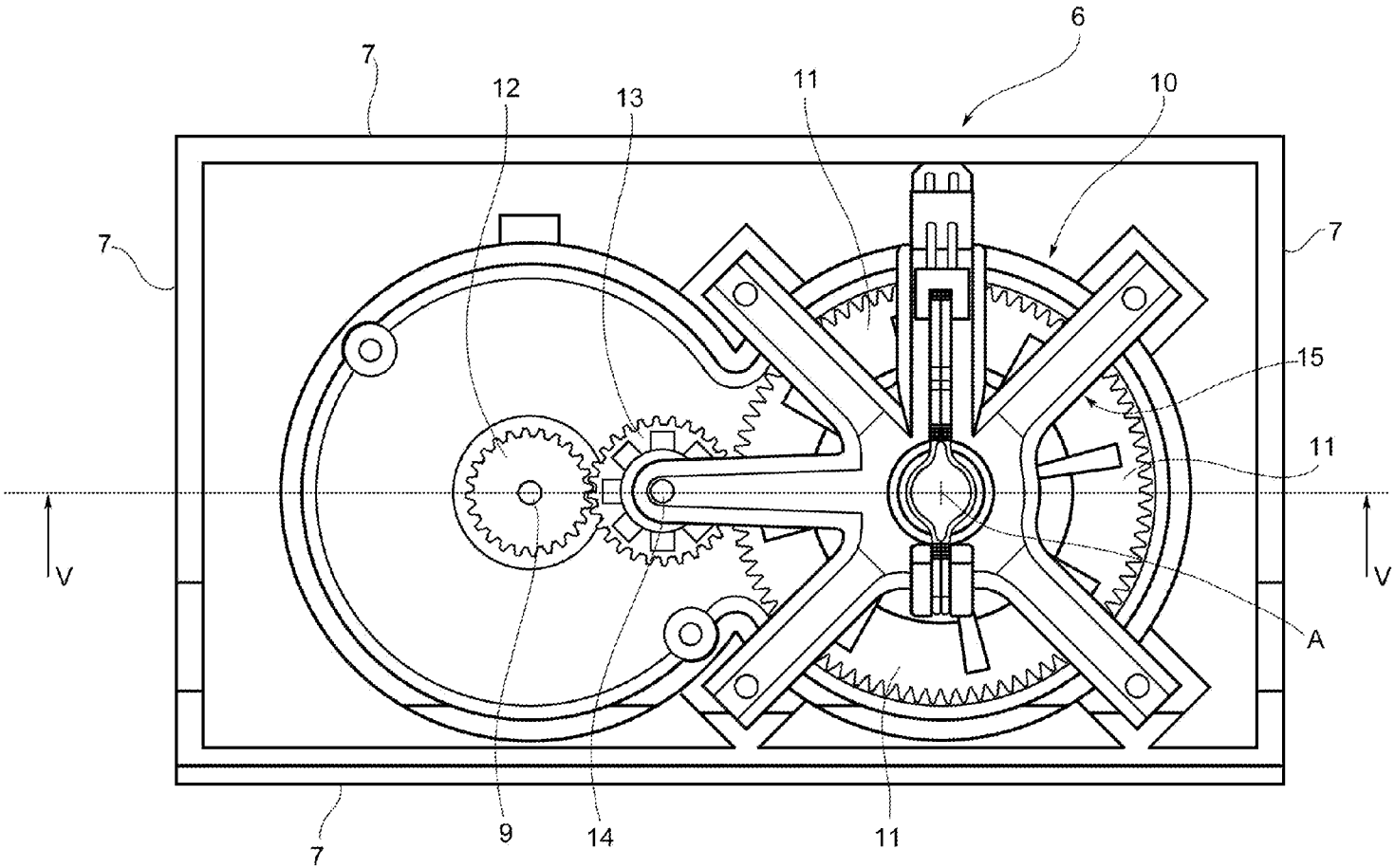
FIG. 4 is a plan view from above of the feeder device according to the preceding figure.

In FIGS. 1 and 2, the number 1 indicates the whole of an apparatus for processing paper documents and the like, particularly for processing bank cheques.

This apparatus may be a scanner, for example one of the type described in patent applications EP 1 453 014 A and EP 1 965 582 filed by the present applicant.

The apparatus 1 comprises a support structure 2 with a front feeder part 2*a*, wherein, between a feeder plate 3 and an opposite flat surface 4, there is defined an input receptacle 5 for the introduction of one or more documents to be processed, for example bank cheques, such as those shown in broken lines and indicated by BC in FIG. 1.

In the illustrated exemplary embodiment, the input receptacle 5 extends essentially horizontally. However, this arrangement or orientation of the input receptacle is not essential or limiting: in other embodiments, the input receptacle may be, for example, essentially vertical.

The formats of the documents to be processed may also vary to some extent, and may be considerably larger than the typical dimensions of cheques.

The feeder plate 3 may be stationary or motorized; in the latter case it is associated with any known device tending to urge it towards the opposite surface 4.

In the illustrated embodiment, the front part 2*a* of the apparatus 1 forms an input feeder device, including a motorized aligning and conveying device indicated as a whole by 6 in FIGS. 1 to 5. The input feeder device is located downstream of a pair of counter-rotating motorized rollers, one of which is visible in FIG. 2, where it is indicated by 100.

The aligning and conveying device 6 essentially comprises a support frame 7, made of moulded plastic material for example, of more or less rectangular shape. In this frame there are mounted an electric control motor 8 (see, in particular, FIGS. 3 and 5), which is, for example, a stepping motor. The shaft of this motor is indicated by 9.

An aligning and conveying assembly, indicated as a whole by 10, is mounted in the support frame 7, beside the motor 8.

Figure 5:
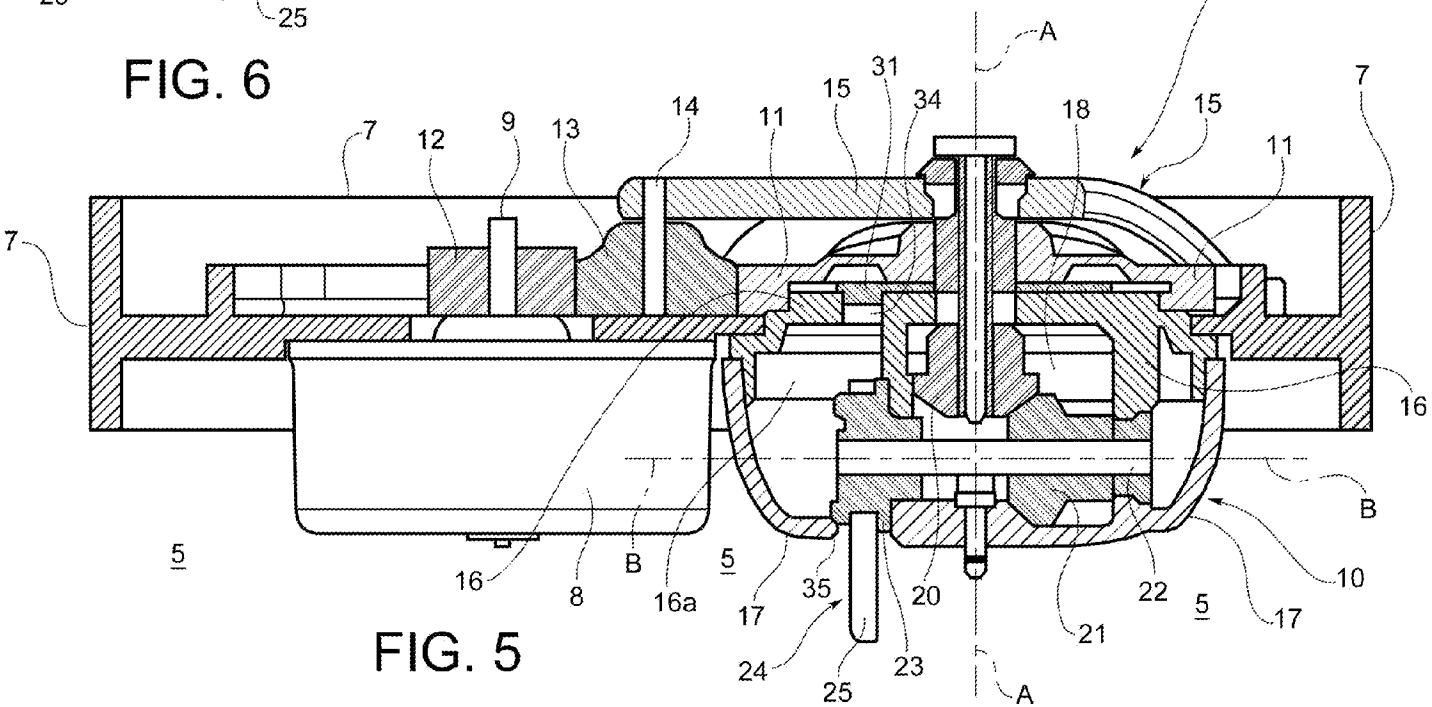
FIG. 5 is a sectional view taken along the line V-V of FIG. 4.

As is shown more fully in FIG. 5, the aligning and conveying assembly 10 protrudes downwards from the support frame 7, extending towards the input receptacle 5.

The assembly 10 is mounted rotatably in the support frame 7 about a first axis A, orthogonal to the feeder plate 3 and to the input receptacle 5 (FIGS. 1 and 5). In the illustrated exemplary embodiment, the axis of rotation A of the assembly 10 is parallel to the axis of the shaft 9 of the electric control motor 8, but this arrangement, although convenient, is not in any way limiting.

The assembly 10 comprises a gear 11 which can be driven in rotation by the electric motor 8, for example through a gear train comprising a pinion 12 keyed on the shaft 9 of the motor 8 and an idler gear 13 interposed between the pinion 12 and the gear 11. The gear 13 is mounted rotatably on a spindle 14 carried by the structure 15 fixed to the support frame 7 (see, in particular, FIG. 5).

The gear 11 is coupled, in the manner described in greater detail below, to an intermediate body 16, which has an annular shell 16*a* on the side opposite the gear, a cap 17 being fitted on to this shell (FIG. 5).

As shown more fully in FIG. 5, a shaft 18 is keyed into an axial through hole of the gear 11 and extends through and beyond a corresponding central opening of the intermediate body 16, protruding into the region 18 lying between this intermediate body 16 and the cap 17.

In the region 18, a conical gear 20 is keyed on to the end of the shaft 19, and engages with a corresponding conical gear 21 carried by a shaft 22 rotatable in the assembly 10 about an axis B.

Figure 6:
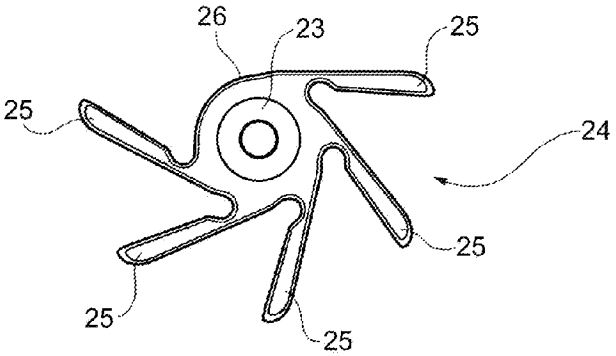
FIG. 6 is a plan view of a pick-up member in the form of a wheel comprising flexible petals, included in a feeder device according to the invention.

The hub 23 of a petal wheel, indicated as a whole by 24 in FIGS. 5 and 6, is keyed to the shaft 22.

The petal wheel 24 is therefore rotatable about the axis B, in a plane remote from the axis A of rotation of the whole aligning and conveying assembly 10. The axis B is also essentially parallel to the feeder plate 3, but this condition is not strictly necessary.

With reference to FIG. 6, in the illustrated embodiment the petal wheel 24 comprises a ring of petals 25 of resiliently flexible material, made, for example, of elastomeric material. The periphery of the hub 23 is not provided with petals over its whole extension, but is free of these petals in a portion 26 which has an extension which for the purposes of illustration may be between 110° and 180°.

As described more fully below, the petal wheel 24 can assume a first angular position, or resting position, relative to the axis B, as shown in FIG. 9*a*, in which its petals 25 extend within the cap 7, substantially without protruding into the input receptacle 5 of the apparatus 1. This position can be detected by means of an appropriate sensor of a known type. However, the petal wheel 24 can move, by rotation about the axis B, into a second angular position, or working position, shown for example in FIG. 10*a*, in which its petals 25 protrude into the input receptacle 5, so as to come into contact with, and thus engage, a document which has been introduced into the receptacle, such as a bank cheque, as described more fully below.

The gear 11 is coupled to the intermediate body 16 of the assembly 10 in the manner which will now be described with particular reference to FIGS. 5, 7 and 8.

Figure 7:
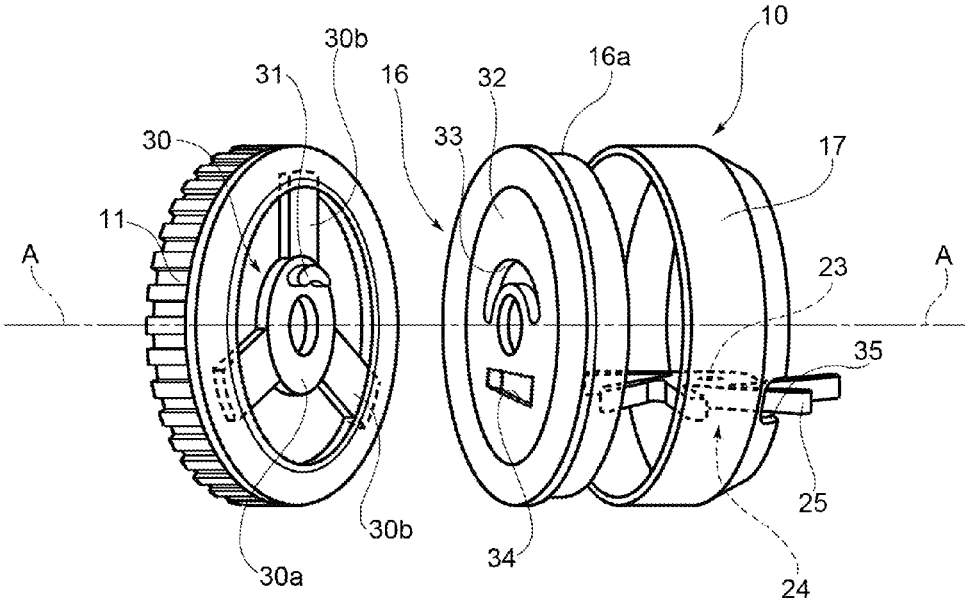
FIG. 7 is a partially exploded partial perspective view of an embodiment of an aligning assembly included in a feeder device according to the invention.
Figure 8:
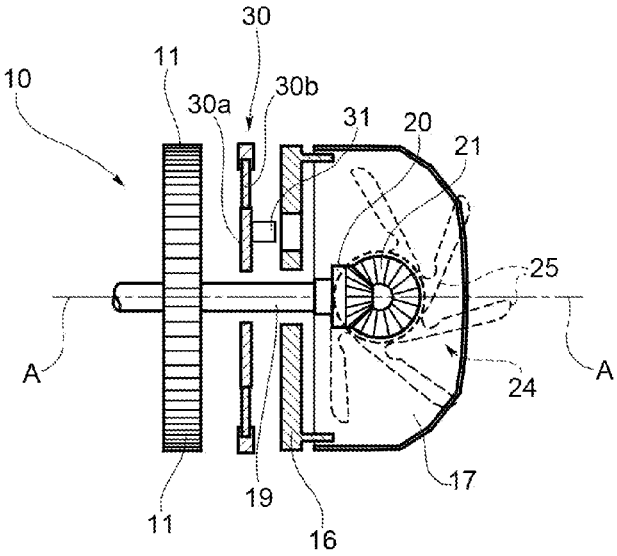
FIG. 8 is a schematic illustration of the forms of coupling between various members of the aligning assembly shown in FIG. 7.

As shown more fully in FIG. 7, on its side facing the intermediate body 16 the gear 11 carries a friction member 30, which in the illustrated exemplary embodiment comprises a central annular portion 30*a* from which there extend a plurality of spokes 30*b* which are angularly slidable in an annular seat or channel provided in the gear 11.

The annular part 30*a* of the friction element 30 has a curved projection 31, which extends along an arc of circumference coaxial with the axis A.

Again with particular reference to FIG. 7, a friction element 32, intended to interact with the friction element 31 of the gear, is fastened to the surface of face of the intermediate body 16 facing towards the gear 11.

In the friction element 32 there is formed a curved slot 33, into which the curved projection 31 of the friction element 30 extends in the assembled configuration of the assembly 10. The slot 33 has a substantially greater angular extension than the projection 31, which can therefore move within this slot, in an angular range of 90° to 130°, for example.

The intermediate body 16 conveniently has a slit 34 (FIG. 7), in a position facing the petal wheel 24, through which the petals 25 of the wheel 24 can extend.

With reference to FIGS. 5 and 7, the cap 17 is also provided with a slit 35 through which the petals 25 of the wheel 24 can extend to the outside of this cap.

The cap 17 is fixed to the intermediate body 16, for example by means of screws (not visible in the drawings).

The gear 11 can only travel over a limited angular path about the axis A relative to the combination formed by the intermediate body 16 and the cap 17. This path corresponds to the path of the projection 31 of the friction element 30 in the slot 33 of the friction element 32 associated with the intermediate body 16.

The arrangement described above is such that the aligning and conveying device 6 can operate according to the operating cycle which will now be described with the aid of FIGS. 9*a* to 12*b*.

When the apparatus 1 is in the resting state, in other words when no document to be processed has been introduced into its input receptacle 5, the aligning and conveying assembly 6 of its input feeder device is in the resting position shown in FIGS. 9*a* and 9*b*, and the assembly 10 is in a predetermined angular position (relative to the axis A) in which the petal wheel 24 extends in a plane P1 (FIG. 9*b*), at a predetermined angle to the desired direction F in which the documents to be introduced into the apparatus 1 are conveyed.

In this condition, the projection 31 is located at one end of the slot 33. Additionally, the petal wheel 24 is located, with respect to its own axis B, in the angular position defined above as the resting position, in which its petals 25 do not protrude into the input receptacle 5, and therefore do not impede the introduction of documents into this receptacle.

The initial angular position of the assembly 10 shown in FIGS. 9*a* and 9*b* can be determined by the effect of the engagement of a projection of the cap 17 against a stop on the support frame 7, and/or by using angular position sensors, associated for example with the gear 11, which are known and are not illustrated.

If one or more documents are introduced into the input receptacle 5 of the apparatus 1 in the resting condition described above, this condition being detected by means of sensors which are also known, for example photocells or the like, an operating cycle taking place according to the procedures described below is initiated.

At the start of this cycle, the electric motor 8 is activated so as to cause the assembly 10 to rotate in the anticlockwise direction as seen by a viewer of FIG. 9*b*.

The gear 11 of the assembly 10 is therefore rotated in a corresponding way. This gear then completes a certain initial travel without causing any rotation of the combination formed by the intermediate body 16 and the cap 17 and the devices enclosed by them, until the projection 31 reaches the other end of the slot 33, as shown in FIG. 10*b*. This initial rotation first causes only a corresponding rotation of the petal wheel 24, which moves from the resting angular position (relative to its axis B) shown in FIG. 9*a* to the working angular position shown in FIG. 10*a*, in which its petals 25 protrude into the input receptacle 5, and engage the document introduced thereinto, or engage the uppermost document if a stack of documents has been introduced.

Figure 10A:
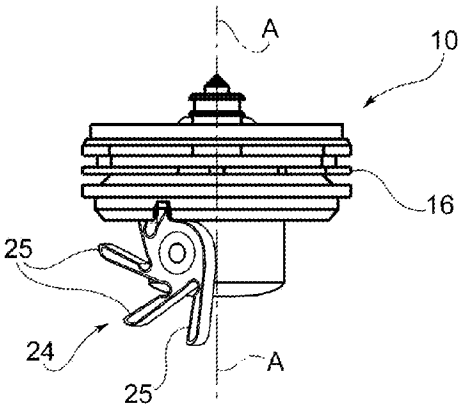
Figure 10B:
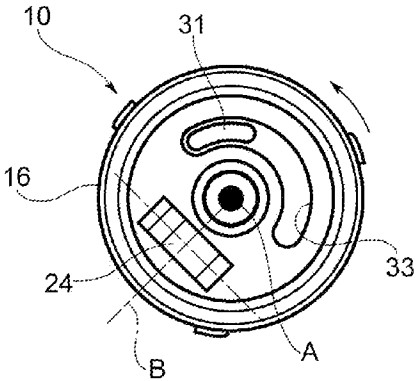
Figure 11A:
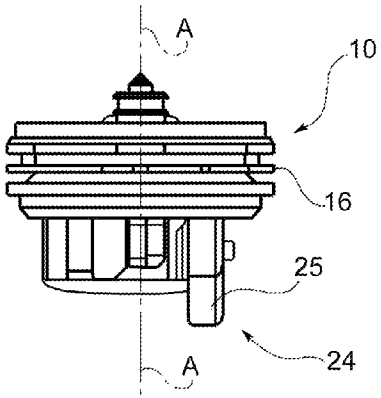
Figure 11B:
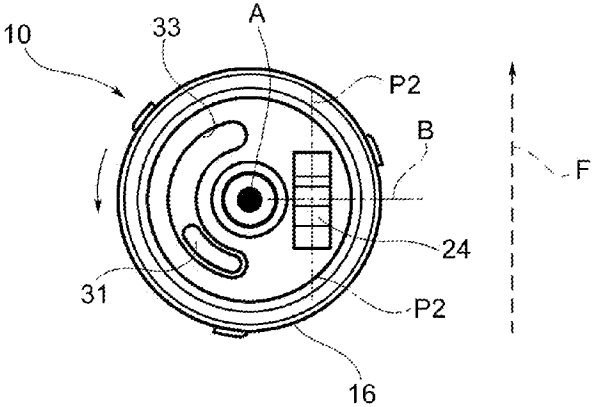

The further rotation of the gear 11, in the anticlockwise direction as seen by a viewer of FIGS. 10*a* and 11*b*, causes the whole aligning and conveying assembly 10 to be driven in rotation.

When the relative angular movement between the gear 11 and the combination formed by the intermediate body 16 and the cap 17 ceases, the petal wheel 24 consequently ceases to be driven in rotation. It therefore remains in the working angular position relative to its axis B. However, it is rotated about the axis A together with the whole assembly 10.

Thus the position shown in FIGS. 11*a* and 11*b* is reached. These figures show the final angular position of the assembly 10, in which the petal wheel 24 is orientated in a plane P2 (FIG. 11*b*) substantially parallel to the desired direction F in which the documents introduced into the apparatus 1 are conveyed. The plane P2 may be slightly inclined, at 5° for example, relative to the conveying direction F, since a subsequent action will take place to align the document.

A comparison of FIGS. 10*a*, 10*b* with FIGS. 11*a*, 11*b* will reveal that the rotation of the assembly 10 causes the document introduced into the input receptacle to be moved in a transverse direction towards a lateral alignment surface indicated by 50 in FIGS. 1 and 2.

When the condition shown in FIGS. 11*a* and 11*b* is reached, the document (or the uppermost document of the group) introduced into the apparatus 1 is correctly aligned against the wall 50, and can then be conveyed towards the inside of the apparatus 1 for further processing, such as scanning. The document is conveyed as a result of the further rotation of the gear 11 (in the anticlockwise direction as seen by a viewer of FIG. 11*b*).

In the condition shown in FIGS. 11*a* and 11*b*, a further rotation of the assembly 10 in the preceding direction is impeded, for example by the effect of the engagement of a projection of the cap 17 against a stop on the support frame 7. However, the further rotation of the gear 11 remains possible because of the slip which occurs between the friction elements 30 and 32 (FIG. 7), and can cause a corresponding rotation of the petal wheel 24, which proceeds to convey the aligned document towards the inside of the processing apparatus 1, in the desired conveying direction F.

Figure 12A:
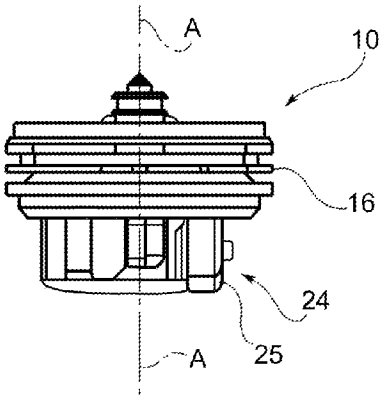
Figure 12B:
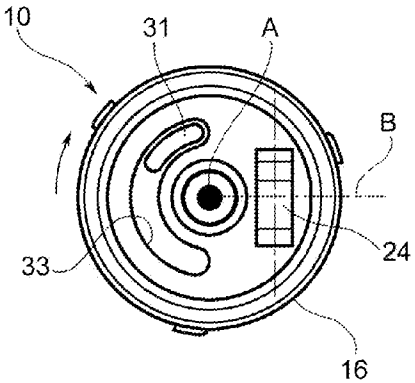

Having been rotated by a predetermined amount which is sufficient to convey the aligned document, the gear 11 is stopped by stopping the electric control motor 8 in a corresponding way. This motor 8 is stopped when the petal wheel 24 is in the resting position, for example by means of a suitable sensor capable of "reading" its position. The motor is then started in the reverse direction, in other words in a clockwise direction as seen by a viewer of FIG. 12*b*. The corresponding rotation of the gear 11 cannot initially move the whole assembly 10 with it, until the projection 31 reaches the other end of the slot 33, as shown in FIG. 12*b*. However, the angular travel completed by the gear 11 up to the condition shown in FIG. 12*b* is sufficient to cause a rotation of the petal wheel 24 such that the latter is brought to the angular position relative to its axis B which has been defined above as the resting position, in which the petals 25 leave the input receptacle 5 of the apparatus 1 free.

Starting from the condition shown in FIG. 12*b*, the further rotation of the gear 11 (still in the clockwise direction as seen by a viewer of this figure) causes the whole aligning and conveying assembly 10 to be driven in rotation until it returns to the initial condition of FIGS. 9*a* and 9*b*. During the last-mentioned rotation, the petal wheel 24 does not rotate about its axis B and therefore remains in its resting condition.

If a plurality of documents is introduced into the apparatus 1, an operating cycle as described above is activated for each of them.

FIG. 13 shows a second embodiment of the aligning and conveying assembly 6. In this figure, parts identical or substantially equivalent to parts described previously have been given the same reference numerals as those used previously.

The embodiment shown in FIG. 13 essentially differs in that a friction device 130, including an annular body 130*a* on which two arms 130*b* are pivoted on the side facing the gear 11, is interposed between the gear 11 and the intermediate body 16. These arms are urged by corresponding springs 130*c* so as to engage an inner annular friction surface 11. The side of the body 130*a* facing the intermediate body 16 has a projection 31 which, as in the embodiment described previously, engages in a slot 33 of the intermediate body 16.

In other respects, the embodiment of FIG. 13 corresponds to that of the preceding figures.

Naturally, the principle of the invention remaining the same, the forms of embodiment and the details of construction may be varied widely with respect to those described and illustrated, which have been given purely by way of non-limiting example, without thereby departing from the scope of the invention as defined by the attached claims.

Thus, for example, the motion may be transmitted from the electric control motor 18 to the gear 11 by transmission means other than a train of gears, for example by means of a belt or chain transmission.

Furthermore, two motors could be used to drive the assembly 6 instead of a single motor, particularly if it is desired to provide faster execution of the whole operating cycle and/or to process larger numbers of documents and/or documents of different formats.

The invention claimed is:

1. An input feeder device for an apparatus for processing paper documents and the like, particularly bank cheques, comprising a support structure wherein, between a feeder plate and an opposite surface, there is defined an input receptacle for the introduction of one or more documents to be processed, and a motorized aligning and conveying device, arranged by said input receptacle and adapted to engage and urge a document introduced into said receptacle towards a lateral stationary aligning surface;

the feeder device being characterized in that the aligning and conveying device comprises an assembly which is rotatable about a first axis which intersects the feeder plate and which includes a pick-up member mounted rotatably in the assembly about a second axis in a plane spaced apart from said first axis, between a first, resting angular position and a second, working angular position, in the first of which positions the pick-up member is retracted, while in the second it protrudes into the assembly in the input receptacle to engage a document introduced thereinto; and electric motor control means, coupled to the assembly and to the pick-up member through transmission means adapted to cause:

while the assembly is in a predetermined initial angular position, the passage of the pick-up member from the resting position to the working position, to engage a document introduced into the input receptacle, thereafter, a rotation of the assembly from the initial angular position to a final angular position, about the first axis, while the pick-up member is in its working position, to urge said document towards and against the aligning surface, thereafter, while the assembly is in the final position, a rotation of the pick-up member about the second axis, to convey the aligned document into the processing apparatus; and finally, the return of the pick-up member to the resting position, and the return of the assembly to the initial angular position.

2. A device according to claim 1, wherein the motor means comprise a single electric driving motor.

3. A device according to claim 1, wherein the transmission means comprise a first, driven gear coupled, with a predetermined angular play, to a body of the rotatable assembly of the aligning and conveying device through a friction device; the axis of rotation of the gear and the body being the first axis of the rotatable assembly; the pick-up member comprising a wheel mounted rotatably with respect to the body about the second axis and provided, on part of its periphery, with a plurality of petal-like, resiliently flexible formations.

4. A device according to claim 3, wherein the petal wheel is carried by a rotatable shaft, adapted to be driven in rotation by the driven gear through a transmission comprising a pair of conical gears contained in the rotatable assembly.

5. A device according to claim 1, wherein the motor means comprise an electric stepping motor.

* * * * *